United States Patent [19]

Schade, Jr.

[11] 4,325,017

[45] Apr. 13, 1982

[54] TEMPERATURE-CORRECTION NETWORK FOR EXTRAPOLATED BAND-GAP VOLTAGE REFERENCE CIRCUIT

[75] Inventor: Otto H. Schade, Jr., North Caldwell, N.J.

[73] Assignee: RCA Corporation, New York, N.Y.

[21] Appl. No.: 177,913

[22] Filed: Aug. 14, 1980

[51] Int. Cl.[3] ..... G05F 1/58

[52] U.S. Cl. ..... 323/313; 323/315; 323/907

[58] Field of Search ..... 323/312–316, 323/907; 307/296, 297

[56] References Cited

U.S. PATENT DOCUMENTS

| | | | |
|---|---|---|---|
| 3,886,435 | 5/1975 | Steckler | 323/4 |
| 4,063,120 | 12/1977 | Idei | 307/297 |
| 4,176,308 | 11/1979 | Dobkin et al. | 323/4 |
| 4,243,948 | 1/1981 | Schade | 323/907 |
| 4,249,122 | 2/1981 | Widlar | 323/313 |
| 4,250,445 | 2/1981 | Brokaw | 323/313 |
| 4,282,477 | 8/1981 | Ahmed | 323/212 |

FOREIGN PATENT DOCUMENTS 52-41541 9/1977 Japan .

OTHER PUBLICATIONS

P. Gray & R. Meyer, "Analysis and Design of Analog Integrated Circuits, Section A4.3.2, "Band-gap-Referenced Biasing Circuits", 1977, pp. 254–261.

R. Van de Plassche, "Dynamic Element Matching for High-Accuracy Monolithic D/A Converters", Digest of Technical Papers, 1976 IEEE International Solid State Circuits Conference, Session XIII, THPM 13.3, pp. 148–149, 240.

R. Widlar, "Low Voltage Techniques", Digest of Technical Papers, 1978 IEEE International Solid-State Circuits Conference, Session XVII, FAM 17.6, pp. 238–239 [Widlar I].

R. Widlar, "Low Voltage Techniques", IEEE Journal of Solid-State Circuits, vol. SC-13, No. 6, Dec. 1978, pp. 838–846 [Widlar II].

"New Developments in IC Voltage Regulators", IEEE Journal of Solid-State Circuits, vol. SC-6, No. 1, Feb. 1971, pp. 2–7.

Data Sheet, "LM136 . . . 2.5V Reference Diode", National Semiconductor Corp. Linear Data Book, 1978, pp. 2–16 to 2–21.

*Primary Examiner*—William H. Beha, Jr.

*Attorney, Agent, or Firm*—E. M. Whitacre; P. J. Rasmussen; C. A. Berard, Jr.

[57] ABSTRACT

A circuit for generating temperature dependent current for compensating an electrical circuit comprises a resistor and a semiconductor junction having different temperature coefficients. A current applied to the semiconductor junction conditions it for conduction and related potentials are maintained across the resistor and the semiconductor junction. Means receiving a portion of the current in one of the resistor and semiconductor junction develops the temperature dependent current in response to the portion. The temperature dependent current is applied to the electrical circuit to effect the desired compensation. One embodiment of the present invention includes a band-gap reference potential generating circuit in which a semiconductor junction thereof receives the temperature dependent current. Other embodiments of the present invention are employed to develop currents that are dependent upon a temperature function raised to a power.

21 Claims, 8 Drawing Figures

TEMPERATURE-CORRECTION NETWORK FOR EXTRAPOLATED BAND-GAP VOLTAGE REFERENCE CIRCUIT

This invention relates to networks for developing a temperature dependent current for compensating an electrical circuit and, in particular, to networks for reducing the temperature variation of the reference potential from extrapolated band-gap voltage reference circuits.

In an extrapolated band-gap voltage reference circuit, a pair of bipolar transistors is operated at different emitter current densities, the difference between their base-emitter voltages exhibiting a positive temperature coefficient. That difference is scaled up and combined with a semiconductor-junction conduction voltage exhibiting a negative temperature coefficient to develop a reference potential exhibiting a substantially reduced temperature coefficient as compared to that of the semiconductor junction.

The reference potential temperature characteristic of a band gap reference is "bow-shaped" in that it tends to have a maximum value at a predetermined temperature and lesser values at higher and lower temperatures, as described in P. Gray and R. Meyer, *Analysis and Design of Analog Integrated Circuits*, Section A4.3.2 Band-Gap Reference Biasing Circuits, pages 254–61. Departures from an invariant reference potential are undesirable because those departures introduce error into the circuit in which the reference potential generating circuit is employed. For example, the accuracy of analog-to-digital conversion circuits and voltage regulator circuits is limited by the accuracy of their reference voltage.

The present invention is an arrangement for reducing the degree to which the reference potential of such circuits exhibits a bow-shaped temperature characteristic. Specifically, a circuit for generating a temperature dependent current includes a resistor and a semiconductor junction having different temperature coefficients. Current flow is established in the semiconductor junction by a current supply and in the resistor because related potentials are maintained across the resistor and the semiconductor junction. The temperature dependent current is developed responsive to the current in one of the resistor and the semiconductor junction and is applied to the electrical circuit to be compensated.

Figure 1:
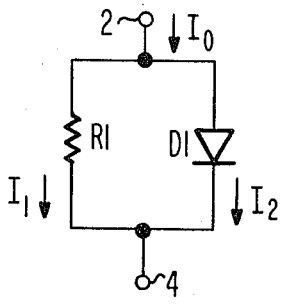
FIGS. 1, 2 and 3 are schematic diagrams useful for the understanding of the present invention.

In the circuit of FIG. 1, resistor R1 is in direct-coupled parallel connection with a semiconductor junction shown by way of example as diode D1. A current $I_0$ applied between connections 2 and 4 conditions D1 for conduction of current $I_2$. Because the conduction potential of D1 is impressed across R1, current $I_1$ flows therethrough.

Where D1 is a silicon PN junction diode, for example, it exhibits a temperature coefficient of approximately −2 millivolts/degree Kelvin. As the temperature of D1 increases, its conduction potential decreases causing a corresponding decrease in the potential across and the current conducted through R1. If the current $I_0$ applied between terminals 2 and 4 remains substantially constant, and the temperature coefficient of D1 is different from that of R1, then the current $I_2$ in diode D1 must increase by a complementary amount since $I_1+I_2=I_0$. On the other hand, when the temperature of D1 decreases, the current $I_1$ conducted by R1 tends to increase and the current $I_2$ conducted by D1 tends to decrease. The net effect is that complementary temperature-dependent currents $I_1$ and $I_2$ flow in R1 and D1, respectively, responsive to current $I_0$ applied between connections 2 and 4.

Currents $I_1$ and $I_2$ can be expressed:

$$I_1=I_0(1-\delta)K_1 \quad (1)$$

$$I_2=I_0(1+\delta)K_2 \quad (2)$$

where: $\delta$ is a term related to temperature; and $K_1$ and $K_2$ are terms representing current division between R1 and D1, the sum of $K_1$ and $K_2$ being unity.

Figure 2:
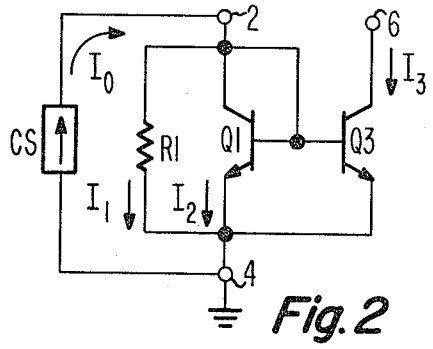

FIG. 2 shows a form of the circuit of FIG. 1 wherein the base-emitter junction of transistor Q1 replaces diode D1. Transistors Q1 and Q3 form a current mirror amplifier (CMA) wherein the base-emitter voltage of Q1 conditions Q3 for conduction of collector-to-emitter current $I_3$. $I_3$ flows between a relatively positive voltage at terminal 6 and a relatively negative voltage, e.g., ground potential, at terminal 4. $I_3$ directly relates to current $I_2$ flowing in Q1 and therefore relates to current $I_0$ from current supply CS by a form similar to equation (2) above. The relative magnitudes of $I_2$ and $I_3$ depend upon the respective emitter areas ($A_e$) of Q1 and Q3.

Figure 3:
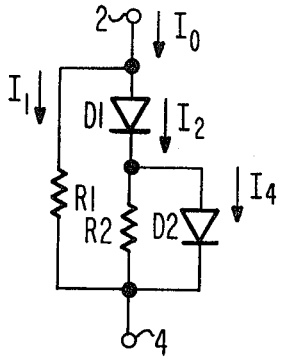

In FIG. 3, currents $I_1$ and $I_2$ are of the form given in equations (1) and (2) above. Current $I_2$ is applied to parallely connected resistor R2 and diode D2 dividing therebetween in similar manner to that discussed above for R1 and D1 in FIG. 1. As a result of that further division of current $I_2$, current $I_4$ is of the form:

$$I_4=I_2(1+\delta)K_3 \quad (3)$$

where: $K_3$ represents current division between R2 and D2. By substituting equation (2) into equation (3), it becomes evident that current $I_4$ includes a factor $(1+\delta)^2$ indicating that $I_4$ includes a component related to a power of a function of temperature greater than unity.

Figure 4:
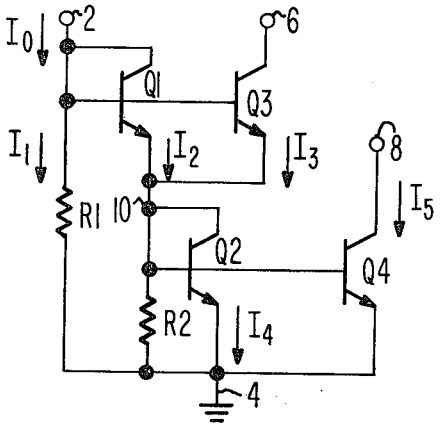
FIGS. 4, 5, 7 and 8 are different embodiments of the present invention.

The circuit of FIG. 4 differs from that of FIG. 3 in that diode-connected transistors Q1 and Q2 replace D1 and D2, respectively, and in that transistor pairs Q1, Q3 and Q2, Q4 form respective CMAs. Q3 receives operating potential from terminal 6 and conducts current $I_3$ between terminal 6 and node 10 responsive to current $I_2$ flowing in transistor Q1. The current applied to parallely connected resistor R2 and diode-connected transistor Q2 is thereby augmented so that the decreased current magnitude caused by division of $I_0$ between R1 and Q1 can be restored. $I_4$ includes a component $(1+\delta)^2$ related to a power of a function of temperature as explained above for FIG. 3. Collector current $I_5$ withdrawn from terminal 8 is related to temperature dependent current $I_4$ by the Q2, Q4 CMA current ratio and also includes a $(1+\delta)^2$ component. So that complementary temperature dependent currents $I_1$ and $I_2$ flow, related potentials are maintained across R1 and the base-emitter of Q1 by the direct-coupled connection of first ends thereof together and by the connections of R2 and the base-emitter of Q2 between nodes 10 and 4.

The result of the circuit of FIG. 4 is extendable to develop currents related to higher powers of functions of temperature, i.e. $(1+\delta)^n$, by employing further cascade connected resistor and diode arrangements in like manner to the development from FIG. 2 to FIG. 4. In practice, however, it is usual that $\delta << 1$ so that the well known mathematical approximation $(1+\delta)^n \approx (1+n\delta)$ holds true. As a consequence, currents related to higher powers of functions of temperature can be developed employing the $(1+n\delta)$ aspect of the invention as is the case for the embodiment of FIG. 5.

Figure 5:
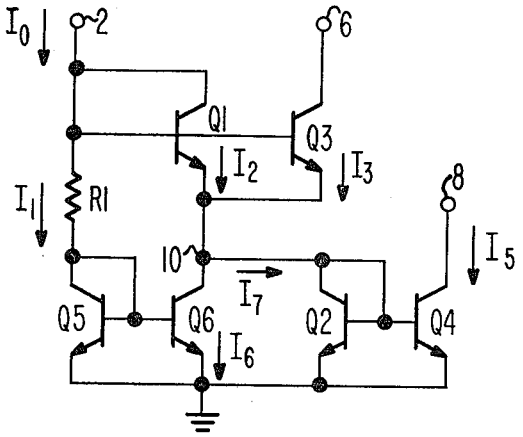

The circuit of FIG. 5 is a modification of FIG. 4 differing in that resistor R2 is replaced by the collector-emitter path of Q6 and in that Q5 is inserted in series with R1. Because Q5 and Q6 form a CMA, collector-emitter current $I_6$ is related to current $I_1$ by the current ratio of the Q5, Q6 CMA. Related potentials are maintained across R1 and the base-emitter of Q1 by the respective base-emitter conduction voltages of diode-connected transistors Q2 and Q5 so that complementary temperature dependent currents $I_1$ and $I_2$ are developed in R1 and Q1 as a result of their having different temperature coefficients. Because Q5 and Q6 form a CMA, collector-emitter current $I_6$ is related to current $I_1$ by the current gain of the CMA and includes a $(1-\delta)$ component. At node 10, $I_6$ is subtracted from $I_2$ which includes a $(1+\delta)$ component. Current $I_3$, which also includes a $(1+\delta)$ component, is also summed at node 10 so that resultant current $I_7$ is $$I_7 = I_2 + I_3 - I_6. \quad (4)$$

When the Q5, Q6 CMA current gain is selected so that $I_2$ and $I_6$ are of equal magnitudes at a certain temperature, the resultant current contains a component proportional to $$(1+\delta)-(1-\delta)=2\delta \quad (5)$$

flowing in the direction indicated by the arrow associated with $I_7$. Further combining current $I_3$ from the Q1, Q3 CMA allows $I_7$ to include a component proportional to $$2\delta+(1+\delta)=(1+3\delta) \quad (6)$$

i.e. tending to approximate dependence upon temperature to the third power.

Other temperature dependencies can be achieved through the selection of the initial current divisions between Q1 and R1, and the current gains of the Q1, Q3 and Q5, Q6 CMAs. For example, where those gains are selected to be two, $I_7$ includes a component proportional to $$(1+\delta)+2(1+\delta)-2(1-\delta)=(1+5\delta) \quad (7)$$

i.e. approximately a fifth power relationship. It is understood that non-integral powers can also be obtained. Current $I_5$, which relates to $I_7$ by the current ratio of the Q2, Q4 CMA, is thus also substantially determined by the aforementioned temperature related term.

The circuits of FIGS. 1-5 are useful themselves in that the temperature dependent currents $I_4$, $I_5$ or $I_7$ can be directly applied to an electrical circuit to compensate a characteristic thereof for temperature. Diode-connected transistor Q2 of either FIG. 4 or FIG. 5, or a semiconductor junction connected in its place, can be included in the electrical circuit that is the object of compensation.

Figure 6:
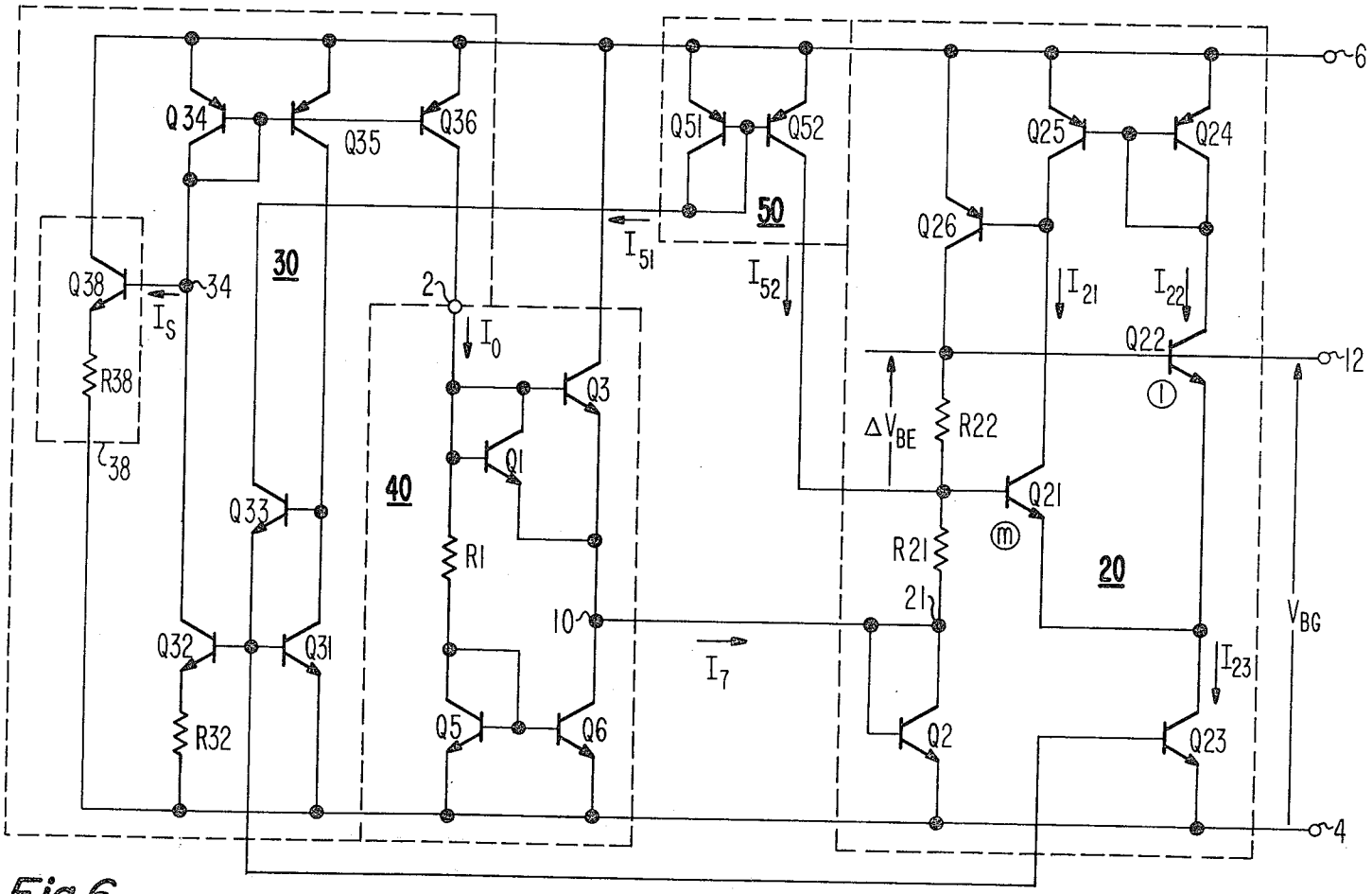
FIG. 6 is a schematic diagram of a band-gap voltage reference circuit including an embodiment of the present invention.

The present inventor has discerned that currents dependent upon temperature raised to the third power, i.e., $(1+\delta)^3 \approx (1+3\delta)$, are particularly suited for temperature correction of the bowed-characteristic of a band-gap voltage reference circuit. In FIG. 6, band-gap reference circuit 20 supplies reference potential $V_{BG}$ between terminals 12 and 4. Its bias current $I_{23}$ is established by bias current loop 30 and it is compensated by temperature dependent current $I_7$ from temperature correction network 40. Compensation network 50 supplies current $I_{52}$ to supply base-current requirements within reference circuit 20 so that errors are not introduced into $V_{BG}$ thereby.

Bias current loop 30 establishes quiescent currents $I_0$, $I_{23}$ and $I_{51}$ of predetermined value. Loop 30 is rendered operative by the application of operating potential between relatively positive supply terminal 6 and relatively negative supply terminal 4. To that end, starting network 38, including resistor R38 and transistor Q38, withdraws a small starting current $I_S$ from node 34. A non-linear current amplifier including transistors Q31, Q32 and Q33 is connected in regenerative feedback connection with the Q34, Q35 CMA. Equilibrium of that loop occurs at a quiescent current level where the product of the respective current gains of the non-linear amplifier and the CMA is unity. See U.S. Pat. No. 4,063,149, "Current Regulating Circuits" issued to B. Crowle.

Quiescent equilibrium current in Q35 is mirrored by output transistor Q36 to supply current $I_0$ to terminal 2 of temperature correction network 40. Quiescent equilibrium current in Q31, substantially equal to that in Q35, is mirrored in like fashion by output transistor Q23 to supply bias current $I_{23}$ to reference potential circuit 20. Q33 supplies base current to Q31 and Q32, and supplies a current $I_{51}$ substantially equal to the combined base currents of Q31, Q32 and Q23 to base current compensation network 50.

Reference potential circuit 20 includes transistors Q21 and Q22 operated at different emitter current densities as determined by their respective emitter areas $A_e$ and currents $I_{21}$ and $I_{22}$. Emitter areas $A_e$ are represented in the drawings by the encircled characters m and 1 proximate to Q21 and Q22, respectively. The relative magnitudes of currents $I_{21}$ and $I_{22}$ are determined by the current gain of the Q24, Q25 CMA, their sum being bias current $I_{23}$. Difference $\Delta V_{BE}$ between the base-emitter conduction potentials of Q21 and Q22 is impressed across resistor R22 and is scaled up across resistor R21. Q26 completes a degenerative feedback connection between the collector and base of Q21 to supply current to R21, R22 and a reference semiconductor junction, shown by way of example as diode-connected transistor Q2. Reference potential $V_{BG}$ comprises the sum of the conduction potentials across Q2, R21 and R22.

Responsive to $I_0$, temperature correction network 40 supplies temperature dependent corrective current $I_7$ to reference potential circuit 20 at node 21. Network 40 is like the circuit of FIG. 5 with Q2 serving as the reference semiconductor junction of reference circuit 20 except that transistor Q4 is not included. $I_7$ includes a component proportional to $(1+3\delta)$ developed as described above in relation to FIG. 5 and can be a substantial portion of the current flowing in Q2.

Compensation network 50 supplies current $I_{52}$ of nominal value equal to base current $I_{B21}$ of Q21 so that scaling up of $\Delta V_{BE}$ by R21 and R22 is minimally affected by $I_{B21}$. Because Q21, Q23, Q31 and Q32 conduct current in known ratio as determined by their relative emitter areas, the ratio between the base current of Q21 and the collector-emitter current $I_{51}$ of Q33 is likewise known. The current gain of the Q51, Q52 CMA is selected to be the inverse of the $I_{B21}/I_{51}$ ratio.

The reference circuit of FIG. 6 is desirably embodied in a monolithic integrated circuit wherein transistor parameters and resistor ratios are maintained to satisfactory accuracy. Thus, accurate scaling-up of $\Delta V_{BE}$ by the R21/R22 ratio, and accurate $I_{21}/I_{22}$ and $I_0/I_{23}$ current ratios and so forth may be desirably obtained. In similar fashion, like transistors will have like current gain characteristics. For example, where all NPN transistors exhibit similar current gain $h_{FE}$, accurate base current compensation by network 50 is achieved.

Where a circuit of the type shown in FIG. 6 is operated between a lower temperature $T_L$ and an upper temperature $T_U$, the temperature $T_P$ at which $V_{BG}$ is at its maximum value could be selected as taught by Gray and Meyer, With $T_P$ selected in that portion of the temperature range closer to $T_L$, network 20 provides reference potential $V_{BG}$ having its most substantial departure from the desired value at temperatures approaching $T_U$. Network 40 is then selected to supply current $I_7$ having lower value near $T_L$ and greater value near $T_U$. That increases the conduction potential of reference semiconductor junction Q2 above that which it would otherwise exhibit, the increase being greater at temperature $T_U$. That increase is selected to be of amount equal to the reduction in $V_{BG}$ predicted by the Gray and Meyer analysis, for example.

It is understood that the temperature dependent current can be applied to the circuit to be compensated such that it subtracts from the current in an element thereof rather than adding to that current as is the case for the circuit of FIG. 6. For example, the complete circuit of FIG. 5 could be employed as network 40 of FIG. 6 with terminal 8 thereof connected to node 21 of band-gap reference circuit 20. Then, current $I_5$ including a term proportional to $(1+3\delta)$ subtracts from the current in reference junction Q2. Because the potential across Q2 would then be greatest near $T_L$, circuit 20 would be designed with $T_P$ selected closer to $T_U$, complementary to that of the preceding paragraph.

Figure 7:
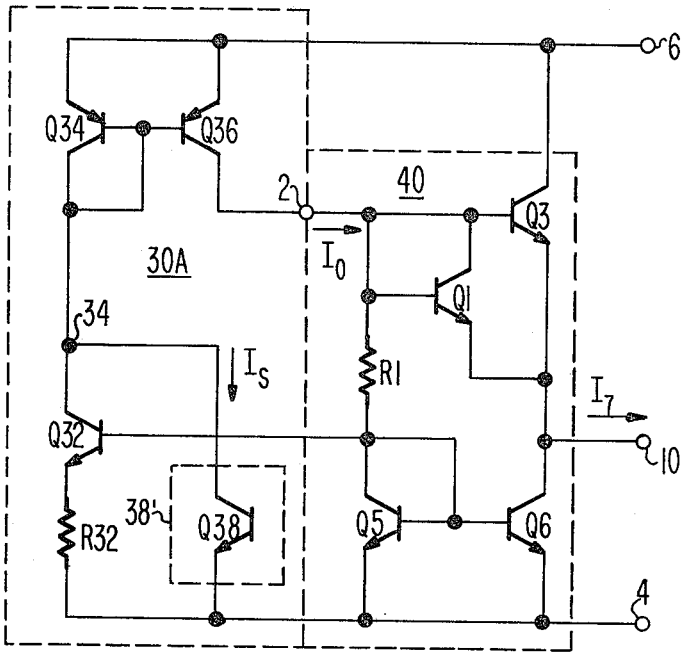

In FIG. 7, modified current loop 30A cooperates with network 40 to develop quiescent bias currents and temperature dependent current $I_7$. Starting network 38' ensures that network 30A becomes operative when power is applied by withdrawing leakage current $I_S$ of Q38 from node 34. Q5 of network 40 cooperates with R32 and Q32 to serve as a non-linear current amplifier in regenerative feedback arrangement with the Q34, Q36 CMA. Quiescent equilibrium obtains in a manner analogous to that described above for network 30. Current loop 30A is desirable in that it requires fewer transistors than does current loop 30 and it is satisfactory when employed with band-gap reference circuits of a type not requiring base current compensation such as is provided by network 50 of FIG. 6. The embodiment of the present invention in network 40 operates in like fashion to that described above in relation to FIGS. 5 and 6.

Figure 8:
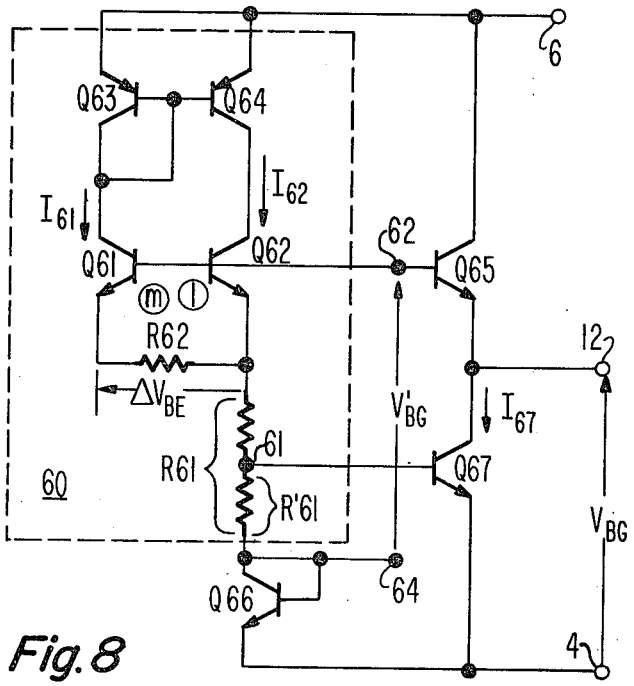

In FIG. 8, reference potential generating circuit 60, shown within the dashed rectangle, is of a type known to those skilled in the art. Transistors Q61 and Q62 are conditioned to operate at different emitter current densities in accordance with their respective emitter areas m and 1 and the current gain of the Q63, Q64 CMA. Difference $\Delta V_{BE}$ between the base-emitter potentials of Q61 and Q62 is developed across resistor R62 and is scaled-up by resistor R61 so reference potential $V'_{BG}$ is developed between output points 62 and 64. $V'_{BG}$ exhibits a bow-shaped characteristic with maximum value at temperature $T_P$.

Reference circuit 60 is modified according to the present invention as follows. Output terminal 12 is driven by emitter follower transistor Q65 responsive to the potential at node 62. Current source load Q67 withdraws current $I_{67}$ from the emitter of Q65. Q66 is inserted between node 64 and terminal 4 to compensate for the reduction in reference potential caused by the base-emitter drop of Q65. As a result, band-gap potential appears between terminals 12 and 4, i.e., $$V_{BG}=V'_{BG}+V_{BE66}-V_{BE65}\simeq V'_{BG} \tag{7}$$

As thus far described, $V_{BG}$ still exhibits a bow-shaped temperature characteristic as does $V'_{BG}$. To reduce the degree to which $V_{BG}$ exhibits a bow-shaped characteristic, the base of Q67 is biased to point 61 intermediate between the ends of resistor R61. The circuit of FIG. 8 is analagous to those of the preceeding figures in that the current in R61, comprising the sum of the emitter currents of Q61 and Q62, is applied to the base of Q67 to condition it for conduction. Further, the potentials across lower portion R'61 of resistor R61 and the base-emitter of Q67 are maintained in predetermined relationship by the base-emitter potential of Q66.

The present inventor has discerned that collector-emitter current $I_{67}$ flowing in Q67 is temperature dependent in that it includes a bow-shape component having its maximum value at the same predetermined temperature $T_P$ as does $V_{BG}$. Because $I_{67}$ is withdrawn from the emitter of Q65, its base-emitter voltage $V_{BE65}$ is caused to exhibit a similar bow. Because $V_{BE65}$ subtracts from $V'_{BG}$, and both exhibit bows of maximum value at $T_P$, the degree to which $V_{BG}$ exhibits a bow-shape is reduced.

Modifications to the specific embodiments discussed with reference to FIGS. 1 through 8 are contemplated to be within the scope of the present invention as defined by the following claims. For example, any of the semiconductor junctions shown therein could be either a diode or a diode-connector transistor. It is equally satisfactory that a Schottky barrier diode or a field-effect transistor be used in place of the diode-connected bipolar transistors shown. Similarly, it is satisfactory that resistor R1 or R2 be replaced by any means exhibiting a resistance. One such resistance means is a FET biased to exhibit a channel resistance between its drain and source electrodes. It is further satisfactory for that resistance means to exhibit a substantial temperature coefficient. For example, monolithic integrated silicon resistors can exhibit a positive temperature coefficient of +1000 to +4000 parts per million per degree Kelvin which additionally enhances the change in current division between R1 and D1 with temperature.

Furthermore, it is equally satisfactory to use the temperature networks described herein with electrical circuits including other band-gap references known to those skilled in the art. In such event, the temperature dependent current could be injected at other points in the circuit. For example, reference circuit 60, shown within the dashed rectangle of FIG. 8, could be compensated by a circuit of the type shown in FIG. 4 with terminal 8 connected to the emitter of Q61.

What is claimed is:

1. A circuit for generating temperature dependent current for reducing the temperature dependence of a temperature dependent signal in an electrical circuit comprising:

resistance means having first and second ends for providing a resistance therebetween that exhibits a temperature coefficient;

semiconductor junction means having first and second ends for exhibiting a conduction potential responsive to current flow therethrough, which conduction potential exhibits a temperature coefficient of different value than that of said resistance;

means for maintaining related potentials across said resistance means and said semiconductor junction means;

current supplying means for supplying current to said resistance means and said semiconductor junction means so that the respective current through each is substantially equal to the difference between said supply current and the current in the other of said resistance means and said semiconductor junction means, whereby the current in each varies at a different rate with temperature;

means connected to one of said resistance means and said semiconductor junction means for receiving a substantial portion of the current therethrough and for developing said temperature dependent current in response to said substantial portion of the current; and means for applying said temperature dependent current to said electrical circuit to effect said reduction.

2. The circuit of claim 1 wherein said means for maintaining related potentials includes a direct coupled connection of the respective first ends of said resistance means and said semiconductor junction means, and further resistance means connected between the respective second ends of said resistance means and said semiconductor junction means.

3. The circuit of claim 2 wherein said further resistance means connects in parallel with a further semiconductor junction means included within said electrical circuit.

4. The circuit of claim 1 wherein said means for maintaining related potentials includes a direct coupled connection of the respective first ends of said resistance means and said semiconductor junction means, and current mirror amplifying means having an input connection for receiving the current flow in said resistor, having an output connection connected to the second end of said semiconductor junction means, and having a common connection.

5. The circuit of claim 4 wherein the output and common connections of said current mirror amplifying means connect to first and second ends, respectively, of further semiconductor junction means included within said electrical circuit.

6. The circuit of claim 1, 2, 3, 4, or 5 further including a transistor having input, output and common electrodes, the input and common electrodes of which respectively connect to the first and second ends of said semiconductor junction means, the output electrode of which receives an operating potential, said transistor being of a type that is conditioned for conduction responsive to the conduction potential of said semiconductor junction means to augment the portion of the current flow in said one of said resistor and said semiconductor junction means.

7. In a potential generating circuit of the type wherein a pair of bipolar transistors is conditioned to operate at different emitter current densities, and the difference between their respective base-emitter junction potentials is scaled up and combined with the forward conduction potential of a reference semiconductor junction to develop a reference potential tending to have a maximum value to a predetermined temperature and lesser values at temperatures removed therefrom, the improvement comprising:

resistance means having first and second ends for providing a resistance that exhibits a temperature coefficient;

semiconductor junction means having first and second electrodes, the first electrode connected to the first end of said resistance means, for exhibiting a conduction potential having a temperature coefficient of value different than that of said resistance; means connected to the second end of said resistance means and to the second electrode of said semiconductor junction means for maintaining the potential therebetween in predetermined relationship;

means for supplying current to the first end of said resistance means and the first electrode of said semiconductor junction means so that the respective current through each is substantially equal to the difference between said supplied current and the current in the other of said resistance means and said semiconductor junction means, whereby the current in each varies at a different rate with temperature; and means having an input connection connected to one of the second end of said resistance means and the second electrode of said semiconductor junction means for receiving a substantial portion of the current flow therethrough, and having an output connection for applying a current responsive to said portion of the current flow to said potential generating circuit to make the lesser value of said reference potential more closely approach the maximum value thereof.

8. The improvement of claim 7 wherein said means for receiving a substantial portion of the current flow includes current mirror amplifying means having an input connection connected for receiving said substantial portion of the current, having an output connection for supplying the current responsive to said portion, and having a common connection.

9. The improvement of claim 8 wherein the input connection of said current mirror amplifying means connects to the second electrode of said semiconductor junction means, and the common connection thereof connects to the second end of said resistance means.

10. The improvement of claim 9 wherein said means for maintaining the potential includes further resistance means connected between the second end of said resistance means and the second electrode of said semiconductor junction means.

11. The improvement of claim 8 wherein the input connection of said current mirror amplifying means connects to the second end of said resistance means, and the output connection thereof connects to the second electrode of said semiconductor junction means.

12. The improvement of claim 11 wherein said means for maintaining the potential includes said reference semiconductor junction being connected between the output and common connections of said current mirror amplifying means.

13. The improvement of claim 7, 8, 9, 10, 11 or 12 further including a transistor having input and common electrodes respectively connected to the first and second electrodes of said semiconductor junction means, having an output electrode connected to receive an operating potential, said transistor being of a type that is conditioned for conduction responsive to the conduction potential of said semiconductor junction means to augment the current flow in said reference semiconductor junction.

14. In a potential generating circuit of the type wherein a pair of bipolar transistors are conditioned to operate at different emitter current densities, and the difference between their respective base-emitter junction potentials is scaled up and combined with the forward conduction potential of a reference semiconductor junction to develop a reference potential tending to have a maximum value at a predetermined temperature and lesser values at temperatures removed therefrom, the improvement comprising:

means for applying a temperature dependent current to said reference semiconductor function, which current includes a component that is dependent upon a function of temperature raised to a power greater than unity, including:

resistance means having first and second ends for providing a resistance that exhibits a temperature coefficient;

semiconductor junction means having first and second ends for exhibiting a conduction potential responsive to current flow therethrough, which conduction potential exhibits a temperature coefficient of different value than that of said resistance;

means for maintaining related potentials across said resistance means and said semiconductor junction means;

current supplying means for supplying current to said resistance means and said semiconductor junction means so that the respective current through each is substantially equal to the difference between said supply current and the current in the other of said resistance means and said semiconductor junction means, whereby the current in each varies at a different rate with temperature;

means connected to one of said resistance means and said semiconductor junction means for receiving a portion of the current therethrough and for developing said temperature dependent current in response to said portion of the current; and wherein said means for applying applies said temperature dependent current to said reference semiconductor junction to make the lesser value of said reference potential more closely approach the maximum value thereof.

15. The improvement of claim 14 wherein said means for maintaining related potentials includes a direct coupled connection of the respective first ends of said resistance means and said semiconductor junction means, and further resistance means connected between the respective second ends of said resistance means and said semiconductor junction means.

16. The improvement of claim 15 wherein said further resistance means connects in parallel with said reference semiconductor junction.

17. The improvement of claim 14 wherein said means for maintaining related potentials includes a direct coupled connection of the respective first ends of said resistance means and said semiconductor junction means, and current mirror amplifying means having an input connection for receiving the current flow in said resistance means, having an output connection connected to the second end of said semiconductor junction means, and having a common connection.

18. The improvement of claim 17 wherein said reference semiconductor junction connects between the output and common connections of said current mirror amplifying means.

19. The improvement of claim 14, 15, 16, 17 or 18 further including a transistor having input, output and common electrodes, the input and common electrodes of which respectively connect to the first and second ends of said semiconductor junction means, the output electrode of which receives an operating potential, said transistor being of a type that is conditioned for conduction responsive to the conduction potential of said semiconductor junction means to augment the current flow in said reference semiconductor junction.

20. In a reference potential generating circuit of the type wherein first and second bipolar transistors of like conductivity type having their base electrodes interconnected are conditioned to operate at different emitter current densities, the difference between their respective base-emitter junction potentials being impressed across a first resistor connected between their respective emitter electrodes, and a second resistor connects at its first end to the emitter electrode of said first transistor for conducting the sum of the emitter currents of said first and second transistors, a reference potential being developed between the base electrode interconnection of said first and second transistors and the second end of said second resistor, the improvement comprising:

first and second output terminals;

semiconductor junction means having a first electrode connecting to the second end of said second resistor, poled for conduction to receive the current therethrough, and having a second electrode connected to said first output terminal;

means included within said second resistor for providing a potential intermediate to those at its first and second ends;

a third bipolar transistor having a base electrode connected to the base electrode of said second transistor, having a collector electrode connected to receive an operating potential, and having an emitter electrode connected to said second output terminal; and a fourth bipolar transistor having a base electrode connected to receive said intermediate potential, having a collector electrode connected to said second output terminal, and having an emitter electrode connected to said first output terminal.

21. The improvement of claim 20 wherein said semiconductor junction means comprises a fifth bipolar transistor having base and collector electrodes connected together to serve as one of the first and second electrodes of said semiconductor junction means, and having a collector electrode connected to serve as the other of the first and second electrodes thereof.

* * * * *